US007743743B2

(12) United States Patent
Inoue et al.

(10) Patent No.: US 7,743,743 B2
(45) Date of Patent: Jun. 29, 2010

(54) VARIABLE VALVE TIMING APPARATUS WITH REDUCED OPERATION SOUND AND CONTROL METHOD THEREOF

(75) Inventors: Yasumichi Inoue, Toyota (JP); Zenichiro Mashiki, Nisshin (JP); Haruyuki Urushihata, Chiryu (JP)

(73) Assignees: Toyota Jidosha Kabushiki Kaisha, Aichi-ken (JP); Denso Corporation, Aichi-ken (JP)

( * ) Notice: Subject to any disclaimer, the term of this patent is extended or adjusted under 35 U.S.C. 154(b) by 616 days.

(21) Appl. No.: 11/690,157

(22) Filed: Mar. 23, 2007

(65) Prior Publication Data

US 2007/0221150 A1 Sep. 27, 2007

(30) Foreign Application Priority Data

Mar. 27, 2006 (JP) ..... 2006-085541

(51) Int. Cl.
*F01L 1/34* (2006.01)

(52) U.S. Cl. ..... 123/90.17; 123/90.15; 123/347; 464/160

(58) Field of Classification Search ..... 123/90.15, 123/90.17, 90.16, 90.18, 345, 346, 347, 348; 464/1, 2, 160

See application file for complete search history.

(56) References Cited

U.S. PATENT DOCUMENTS

| | | | |
|---|---|---|---|
| 6,397,803 | B1 | 6/2002 | Fujiwara et al. |
| 2003/0121486 | A1 | 7/2003 | Komazawa et al. |

FOREIGN PATENT DOCUMENTS

| | | | |
|---|---|---|---|
| JP | 7-233713 | A | 9/1995 |
| JP | 2000-145485 | A | 5/2000 |
| JP | 2002-250240 | A | 9/2002 |
| JP | 2003-145485 | A | 5/2003 |
| JP | 2003-172109 | A | 6/2003 |
| JP | 2004-300924 | A | 10/2004 |
| JP | 2005-105891 | A | 4/2005 |

*Primary Examiner*—Ching Chang
(74) *Attorney, Agent, or Firm*—Sughrue Mion, PLLC

(57) ABSTRACT

In a variable valve timing apparatus in which a phase of an intake valve is changed at an amount of change according to a rotational speed of relative rotation between an electric motor as an actuator and a camshaft, the set upper limit value of the rotational speed of relative rotation and a coefficient Nθ of conversion from a required phase-change amount to the rotational speed of relative rotation ΔNm in each control period are set at smaller values at the time of engine stop than at the time of engine operation. As a result, the rotational speed of the electric motor in the VVT operation at the time of engine stop is reduced thereby reducing the operation sound of the variable valve timing apparatus.

18 Claims, 13 Drawing Sheets

VARIABLE VALVE TIMING APPARATUS WITH REDUCED OPERATION SOUND AND CONTROL METHOD THEREOF

This nonprovisional application is based on Japanese Patent Application No. 2006-085541 filed with the Japan Patent Office on Mar. 27, 2006, the entire contents of which are hereby incorporated by reference.

BACKGROUND OF THE INVENTION

1. Field of the Invention

The present invention relates to a variable valve timing apparatus and more particularly to a variable valve timing apparatus including an electric motor as an actuator and a control method thereof.

2. Description of the Background Art

VVT (Variable Valve Timing) has conventionally been known that changes the phase (crank angle) in (at) which an intake valve or an exhaust valve is opened/closed, according to an operating condition. Generally, a variable valve timing apparatus changes the phase by rotating, relative to a sprocket or the like, a camshaft that drives the intake valve or exhaust valve to open/close. The camshaft is rotated by such an actuator as hydraulic or electric motor.

Such a variable valve timing apparatus may be operated not only at the time of engine operation but also at the time of engine stop to change a valve timing (valve phase). As for the variable valve timing at the time of engine stop, for example, Patent Publication 1 (Japanese Patent Laying-Open No. 2004-300924) discloses control at the time of engine stop in a variable valve apparatus that continuously changes the valve timing and the valve lift amount by shifting a three-dimensional cam in the direction of a camshaft.

Specifically, the variable valve apparatus disclosed in Patent Document 1 drives valve lift amount change means and also detects the amount of shift of the cam, in a case where the camshaft need to be axially shifted at the time of engine stop. When the detected amount of shift of the cam is smaller than a set value, the driving time of the valve lift amount change means is checked. Then, if the driving time of the valve lift amount change means exceeds the set time, the driving of the valve lift amount change means is stopped thereby saving consumption power to prolong the battery life and preventing overheating resulting from overload to improve the reliability of the system.

Generally, in a vehicle on which an engine is mounted, among a variety of mounted equipment, the engine produces a relatively loud operation sound. Therefore, at the time of engine stop, the passenger is likely to perceive the operation sound of other equipment as unusual sound or noise. Therefore, the likelihood that the passenger perceives the operation sound of the variable valve timing apparatus is also preferably reduced by reducing the operation sound of an actuator such as an electric motor. However, Patent Document 1 never mentions such a problem. Although Patent Document 1 discloses that the driving time of the valve lift amount change means, namely the operation time of the actuator is restricted at the time of engine stop, the document does not make any mention of how to define the operation time.

SUMMARY OF THE INVENTION

An object of the present invention is to provide a variable valve timing apparatus in which an operation sound can be reduced at the time of engine stop when a passenger is more likely to perceive noise.

A variable valve timing apparatus according to the present invention changes an opening/closing timing of at least any one of an intake valve and an exhaust valve provided to an engine. The variable valve timing apparatus includes an actuator, a change mechanism and an actuator operation amount setting portion. The change mechanism changes the opening/closing timing by changing difference in rotational phase of a camshaft driving the valve having the opening/closing timing changed, from a rotational phase of a crankshaft, at an amount of change according to an operation amount of the actuator. The actuator operation amount setting portion sets the operation amount of the actuator, based on a deviation between the opening/closing timing at present of the valve having the opening/closing timing changed and a target value thereof. Further, in a case where the opening/closing timing is changed at a time of the engine stop, the actuator operation amount setting portion includes an actuator limiting portion setting the operation amount of the actuator to be relatively smaller than at a time of engine operation.

Alternatively, a variable valve timing apparatus changing an opening/closing timing of at least any one of an intake valve and an exhaust valve provided to an engine includes an actuator, a change mechanism and a control unit. The change mechanism changes the opening/closing timing by changing difference in rotational phase of a camshaft driving a valve having the opening/closing timing changed, from a rotational phase of a crankshaft, at an amount of change according to an operation amount of the actuator. The control unit sets the operation amount of the actuator, based on a deviation between the opening/closing timing at present of the valve having the opening/closing timing changed and a target value thereof. Further, in a case where the opening/closing timing is changed at a time of the engine stop, the control unit sets the operation amount of the actuator to be relatively smaller than at a time of engine operation.

According to the present invention, a control method of a variable valve timing apparatus is provided. The variable valve timing apparatus changes an opening/closing timing of at least any one of an intake valve and an exhaust valve provided to an engine. The change mechanism changes the opening/closing timing by changing difference in rotational phase of a camshaft driving a valve having the opening/closing timing changed, from a rotational phase of a crankshaft, at an amount of change according to an operation amount of the actuator.

The control method includes an operation amount setting step and an operation amount limiting step. At the operation amount setting step, the operation amount of the actuator is set based on a deviation between the opening/closing timing at present of the valve having the opening/closing timing changed and a target value thereof. At the operation amount limiting step, the operation amount of the actuator set at the operation amount setting step is set to be relatively smaller than at a time of engine operation, in a case where the opening/closing timing is changed at a time of the engine stop.

According to the variable valve timing apparatus or the control method thereof as described above, the actuator operation amount at the time of engine stop can be made relatively small as compared with the time of engine operation. Therefore, at the time of engine stop when the passenger is more likely to perceive noise, in consideration of less need for increasing the speed of changing the opening/closing timing, the actuator operation amount is reduced so that the operation sound of the variable valve timing apparatus is thus reduced, thereby preventing unusual sound or noise from being perceived by the passenger.

Preferably, in the variable valve timing apparatus according to the present invention, the actuator limiting portion sets an upper limit value of the operation amount of the actuator in each control period to be smaller at a time of the engine stop than at a time of the engine operation. Alternatively, the control unit sets an upper limit value of the operation amount of the actuator in each control period to be smaller at a time of the engine stop than at a time of the engine operation.

Preferably, in the control method of a variable valve timing apparatus according to the present invention, at the operation amount limiting step, an upper limit value of the operation amount of the actuator at the operation amount setting step in each control period is set smaller at a time of the engine stop than at a time of the engine operation.

According to the variable valve timing apparatus or the control method thereof as described above, the upper limit value of the operation amount of the actuator in each control period is set relatively small at the time of engine stop so that the actuator operation amount at the time of engine stop is reduced thereby reducing the operation sound.

Preferably, in the variable valve timing apparatus according to the present invention, the actuator limiting portion sets a calculation ratio of the operation amount of the actuator to the deviation of the opening/closing timing in each control period to be smaller at a time of engine stop than at a time of engine operation. Alternatively, the control unit sets a calculation ratio of the operation amount of the actuator to the deviation of the opening/closing timing in each control period to be smaller at a time of engine stop than at a time of engine operation.

Preferably, in the control method of a variable valve timing apparatus according to the present invention, at the operation amount limiting step, a calculation ratio of the operation amount of the actuator to the deviation of the opening/closing timing at the operation amount setting step in each control period is set smaller at a time of the engine stop than at a time of the engine operation.

According to the variable valve timing apparatus or the control method thereof as described above, a calculation ratio of the operation amount of the actuator to the deviation of the opening/closing timing in each control period is set relatively small at the time of engine stop so that the actuator operation amount is reduced at the time of engine stop thereby reducing the operation sound.

Preferably, in the variable valve timing apparatus or the control method thereof according to the present invention, at a time of the engine stop, the target value of the opening/closing timing is set at a prescribed value suitable for a next engine start.

According to the variable valve timing apparatus or the control method thereof as described above, the opening/closing timing (valve timing) at the time of engine stop is changed so that the next engine starting can be performed smoothly.

Preferably, the variable valve timing apparatus according to the present invention further includes a setting portion and a forcedly stopping portion. The setting portion sets an operation period after stopping, according to a deviation of an actual value of the opening/closing timing at a time of the engine stop from the target value of the opening/closing timing at a time of the engine stop. The forcedly stopping portion forcedly stops an operation of the actuator when the operation period after stopping set by the setting portion has elapsed since the time of the engine stop. Alternatively, the control unit sets an operation period after stopping, according to a deviation of an actual value of the opening/closing timing at a time of the engine stop from the target value of the opening/closing timing at a time of the engine stop, and in addition, forcedly stops an operation of the actuator when the set operation period after stopping has elapsed since the time of the engine stop.

Preferably, the control method of a variable valve timing apparatus according to the present invention further includes a setting step and a forcedly stopping step. At the setting step, an operation period after stopping is set according to a deviation of an actual value of the opening/closing timing at a time of the engine stop from the target value of the opening/closing timing at a time of the engine stop. At the forcedly stopping step, an operation of the actuator is forcedly stopped when the operation period after stopping set at the setting step has elapsed since the time of the engine stop.

According to the variable valve timing apparatus or the control method thereof as described above, a period from the time of engine stop to the time of forcedly stopping the actuator (operation period after stopping) can be set appropriately in view of the characteristics of the change mechanism. This ensures the actuator operation period required for the valve phase to be set to an appropriate phase in stopping. In addition, power consumption is saved and overheating is prevented which results from overload due to the unnecessarily long operation period.

Preferably, in the variable valve timing apparatus according to the present invention, the actuator is formed of an electric motor and the operation amount of the actuator is a rotational speed difference of the electric motor relative to a rotational speed of the camshaft.

According to the variable valve timing apparatus as described above, the electric motor is an actuator and the operation amount of the actuator is a rotational speed difference of the electric motor relative to the camshaft of which rotation is stopped in engine stop. In this configuration, the rotational speed of the electric motor is set low at the time of engine stop thereby reducing the operation sound of the electric motor.

Therefore, the main advantage of the present invention is to reduce the operation sound of the variable valve timing apparatus at the time of engine stop when the passenger is more likely to perceive noise.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
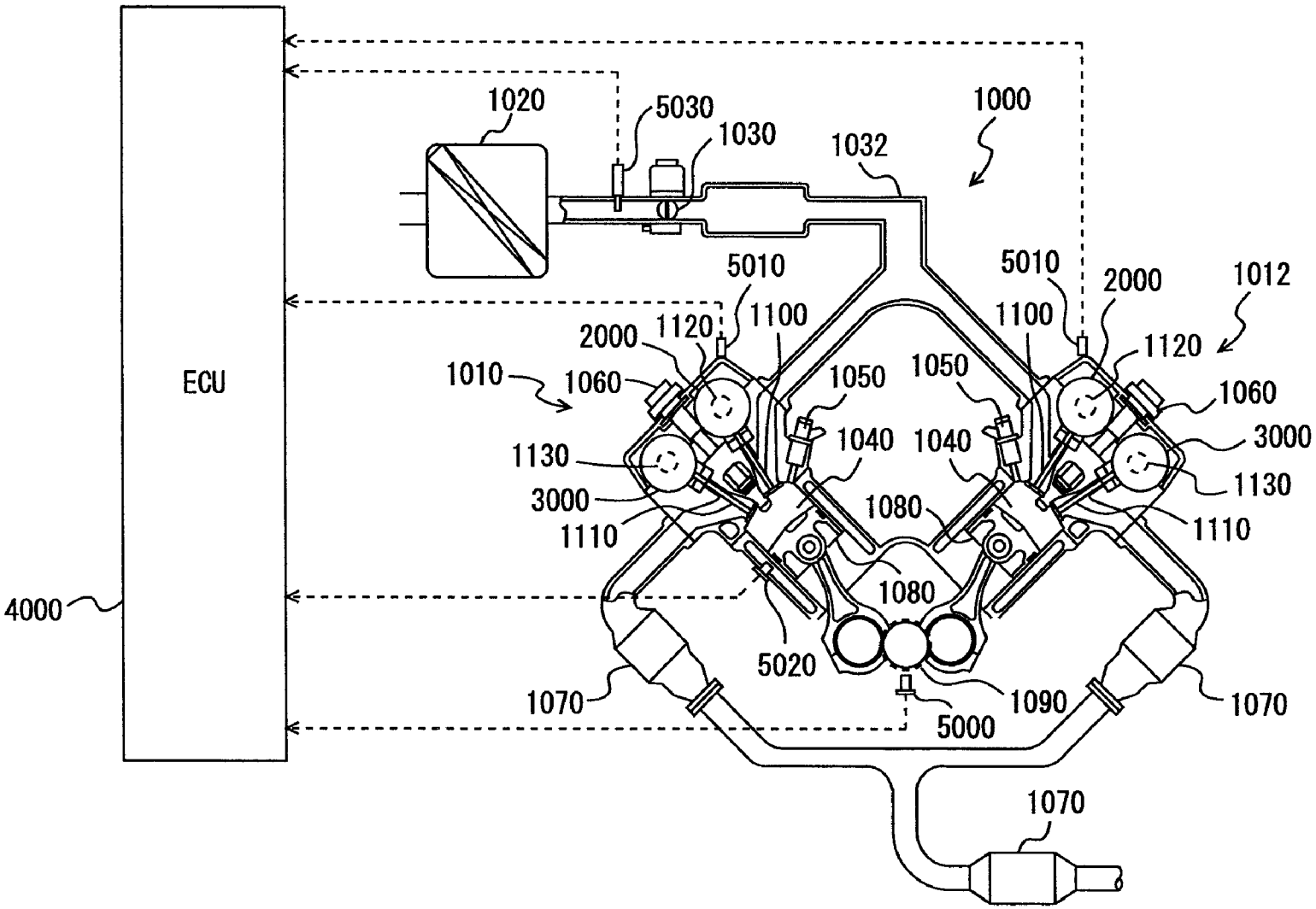
FIG. 1 is a schematic showing a configuration of an engine of a vehicle on which a variable valve timing apparatus is mounted according to an embodiment of the present invention.

With reference to the drawings, an embodiment of the present invention is hereinafter described. In the following description, like components are denoted by like reference characters. They are also named identically and function identically. Therefore, a detailed description thereof is not repeated.

Referring to FIG. 1, a description is given of an engine of a vehicle on which a variable valve timing apparatus is mounted, according to an embodiment of the present invention.

An engine 1000 is a V-type 8-cylinder engine having a first bank 1010 and a second bank 1012 each including a group of four cylinders. Here, the application of the present invention does not limit engine types, and the variable valve timing apparatus as described below is applicable to any engine other than the V8 engine.

Into engine 1000, air is sucked from an air cleaner 1020. The quantity of sucked air is adjusted by a throttle valve 1030. Throttle valve 1030 is an electronic throttle valve driven by a motor.

The air is supplied through an intake manifold 1032 into a cylinder 1040. The air is mixed with fuel in cylinder 1040 (combustion chamber). Into cylinder 1040, the fuel is directly injected from an injector 1050. In other words, injection holes of injector 1050 are provided within cylinder 1040.

The fuel is injected in the intake stroke. The fuel injection timing is not limited to the intake stroke. Further, in the present embodiment, engine 1000 is described as a direct-injection engine having injection holes of injector 1050 that are disposed within cylinder 1040. However, in addition to direct-injection injector 1050, a port injector may be provided. Moreover, only the port injector may be provided.

The air-fuel mixture in cylinder 1040 is ignited by a spark plug 1060 and accordingly burned. The air-fuel mixture after burned, namely exhaust gas, is cleaned by a three-way catalyst 1070 and thereafter discharged to the outside of the vehicle. The air-fuel mixture is burned to press down a piston 1080 and thereby rotate a crankshaft 1090.

At the top of cylinder 1040, an intake valve 1100 and an exhaust valve 1110 are provided. Intake valve 1100 is driven by an intake camshaft 1120. Exhaust valve 1110 is driven by an exhaust camshaft 1130. Intake camshaft 1120 and exhaust camshaft 1130 are coupled by such parts as a chain and gears to be rotated at the same rotational speed (half the rotational speed of crankshaft 1090). Here, the rotational speed of a rotator such as a shaft is commonly represented by revolutions per unit time (typically, revolutions per minute (rpm)).

Intake valve 1100 has its phase (opening/closing timing) controlled by an intake VVT mechanism 2000 provided to intake camshaft 1120. Exhaust valve 1110 has its phase (opening/closing timing) controlled by an exhaust VVT mechanism 3000 provided to exhaust camshaft 1130.

In the present embodiment, intake camshaft 1120 and exhaust camshaft 1130 are rotated by the VVT mechanisms to control respective phases of intake valve 1100 and exhaust valve 1110. Here, the phase control method is not limited to the aforementioned one.

Figure 3:
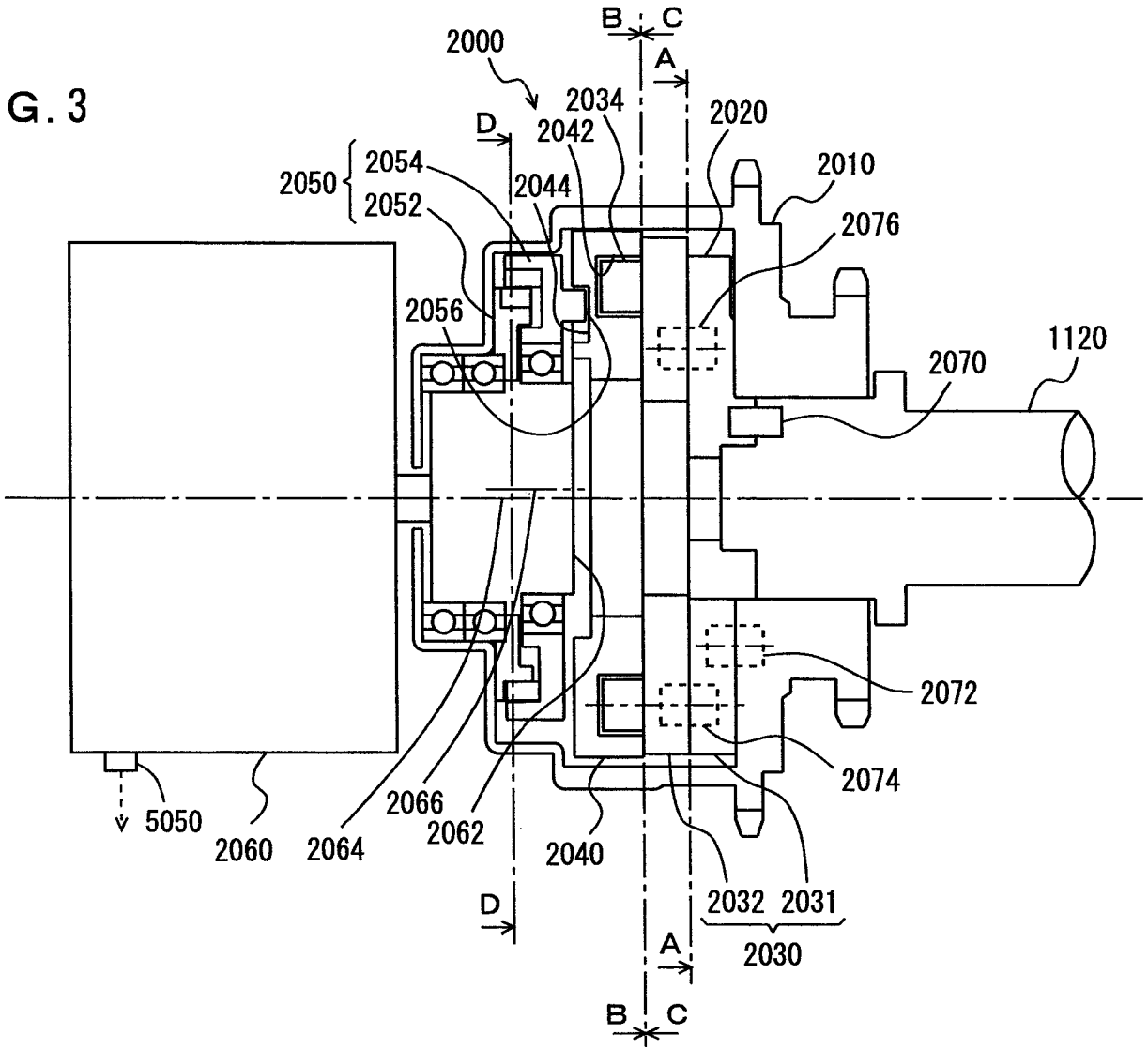
FIG. 3 is a cross section showing an intake VVT mechanism.

Intake VVT mechanism 2000 is operated by an electric motor 2060 (shown in FIG. 3). Electric motor 2060 is controlled by an ECU (Electronic Control Unit) 4000. The current and voltage of electric motor 2060 are detected by an ammeter (not shown) and a voltmeter (not shown) and the measurements are input to ECU 4000.

Exhaust VVT mechanism 3000 is hydraulically operated. Here, intake VVT mechanism 2000 may be hydraulically operated while exhaust VVT mechanism 3000 may be operated by an electric motor.

To ECU 4000, signals indicating the rotational speed and the crank angle of crankshaft 1090 are input from a crank angle sensor 5000. Further, to ECU 4000, signals indicating respective phases of intake camshaft 1120 and exhaust camshaft 1130 (phase: the camshaft position in the rotational direction) are input from a cam position sensor 5010.

Furthermore, to ECU 4000, a signal indicating the water temperature (coolant temperature) of engine 1000 from a coolant temperature sensor 5020 as well as a signal indicating the quantity of intake air (quantity of air taken or sucked into engine 1000) of engine 1000 from an airflow meter 5030 are input.

Based on these signals input from the sensors as well as a map and a program stored in a memory (not shown), ECU 4000 controls the throttle opening position, the ignition timing, the fuel injection timing, the quantity of injected fuel, the phase of intake valve 1100 and the phase of exhaust valve 1110 for example, so that engine 1000 is operated in a desired operating state.

Figure 2:
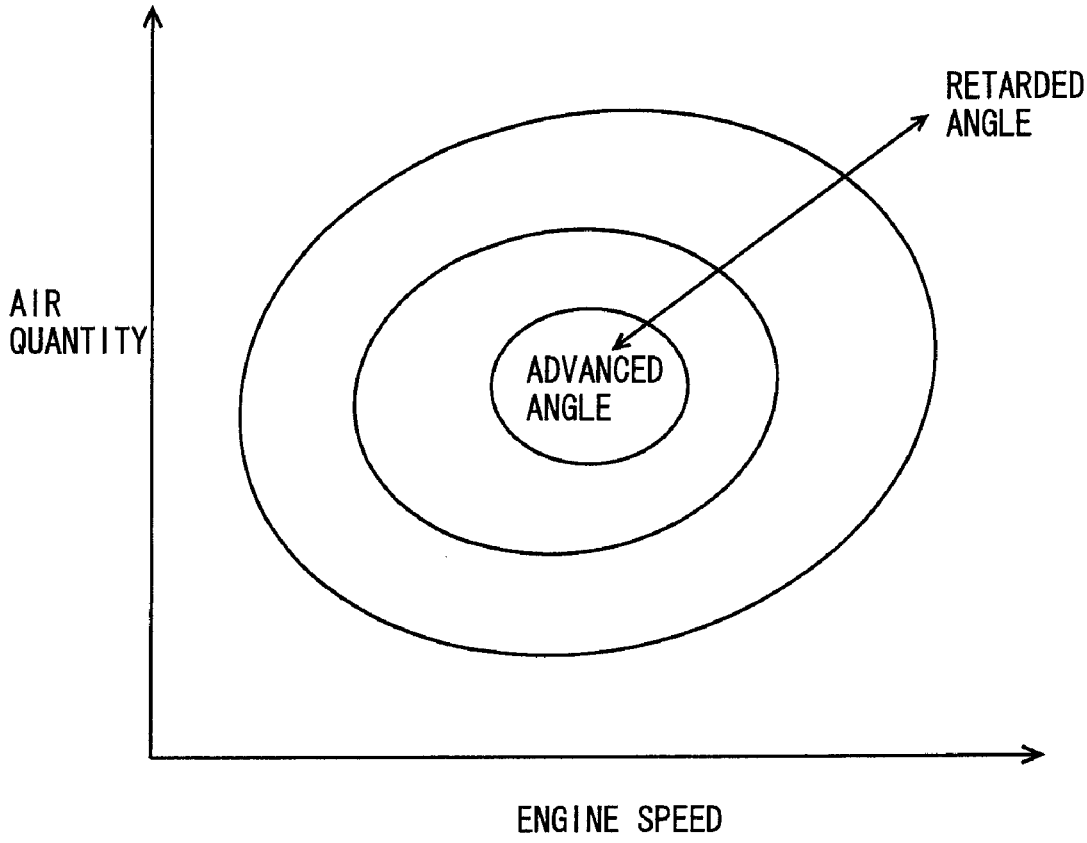
FIG. 2 shows a map defining the phase of an intake camshaft.

In the present embodiment, ECU 4000 determines the phase of intake valve 1100 based on the map as shown in FIG. 2 that uses the engine speed NE and the intake air quantity KL as parameters. A plurality of maps for respective coolant temperatures are stored for determining the phase of intake valve 1100.

In the following, a further description is given of intake VVT mechanism 2000. Here, exhaust VVT mechanism 3000 may be configured identically to intake VVT mechanism 2000 as described below. Moreover, each of intake VVT mechanism 2000 and exhaust VVT mechanism 3000 may be configured identically to intake VVT mechanism 2000 as described below.

As shown in FIG. 3, intake VVT mechanism 2000 includes a sprocket 2010, a cam plate 2020, a link mechanism 2030, a guide plate 2040, a reduction gear 2050, and electric motor 2060.

Sprocket 2010 is coupled via a chain or the like to crankshaft 1090. The rotational speed of sprocket 2010 is half the rotational speed of crankshaft 1090, similarly to intake camshaft 1120 and exhaust camshaft 1130. Intake camshaft 1120 is provided concentrically with the rotational axis of sprocket 2010 and rotatably relative to sprocket 2010.

Cam plate 2020 is coupled to intake camshaft 1120 with a pin (1) 2070. Cam plate 2020 rotates in sprocket 2010, together with intake camshaft 1120. Here, cam plate 2020 and intake camshaft 1120 may be integrated into one unit.

Figure 4:
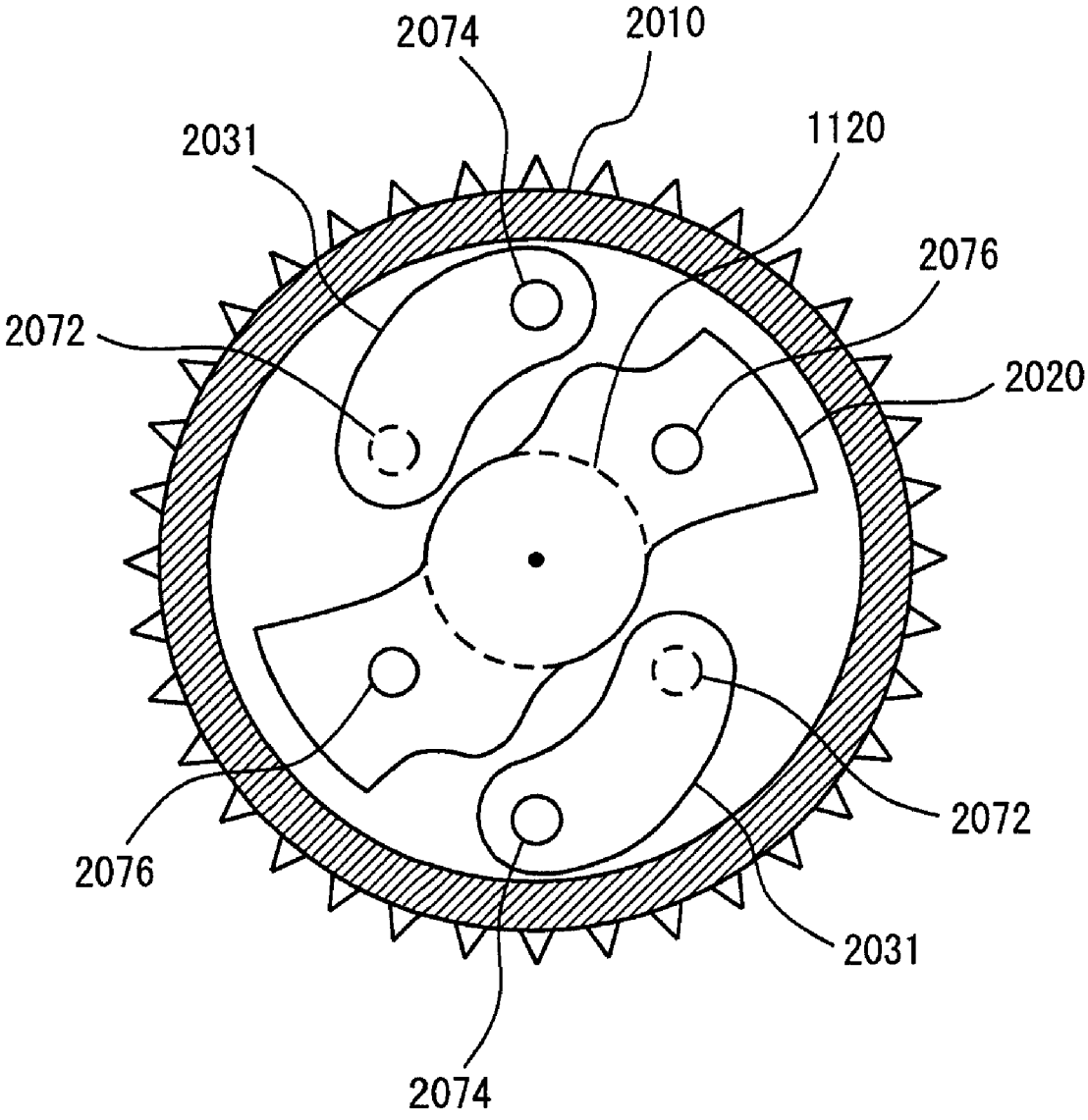
FIG. 4 is a cross section along A-A in FIG. 3.

Link mechanism 2030 is comprised of an arm (1) 2031 and an arm (2) 2032. As shown in FIG. 4 which is a cross section along A-A in FIG. 3, a pair of arms (1) 2031 is provided within sprocket 2010 so that the arms are point symmetric to each other with respect to the rotational axis of intake camshaft 1120. Each arm (1) 2031 is coupled to sprocket 2010 so that the arm can swing about a pin (2) 2072.

Figure 5:
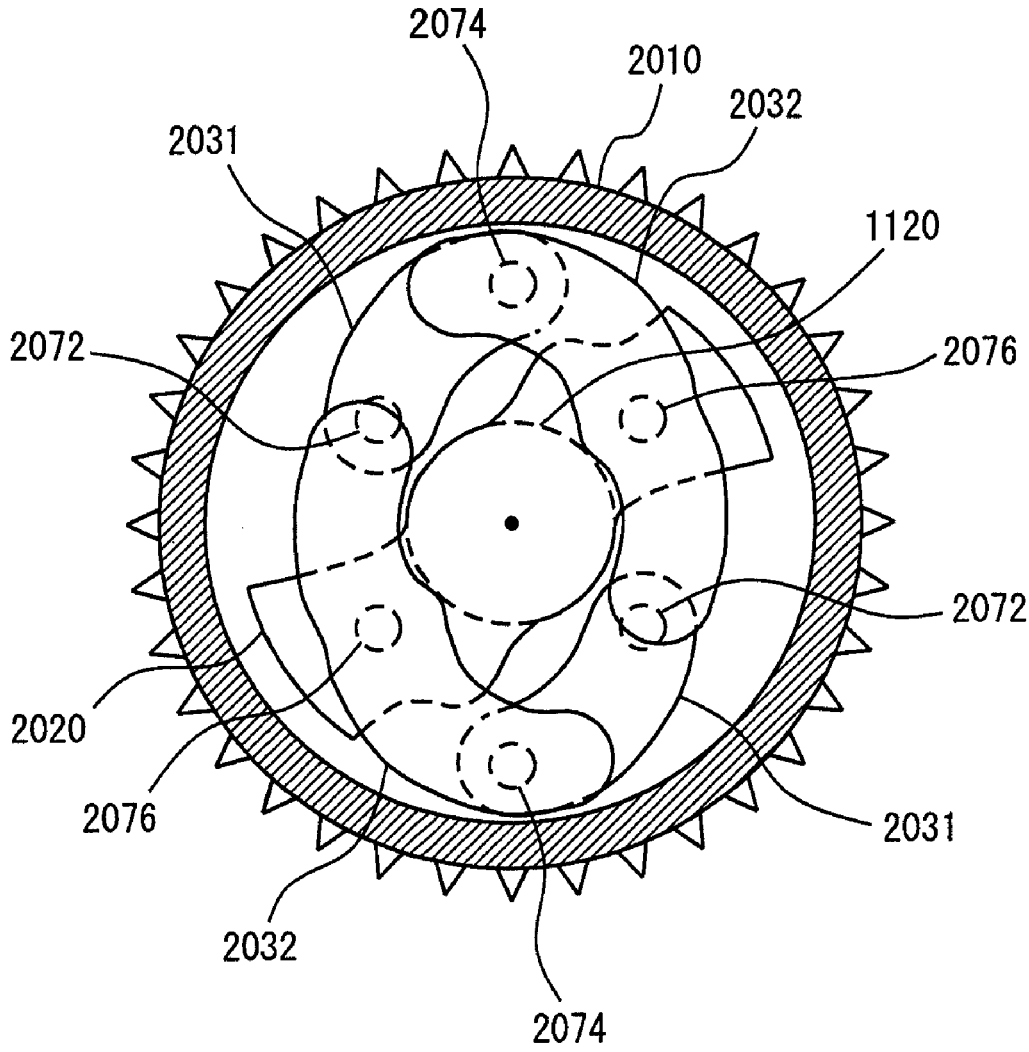
FIG. 5 is a (first) cross section along B-B in FIG. 3.
Figure 6:
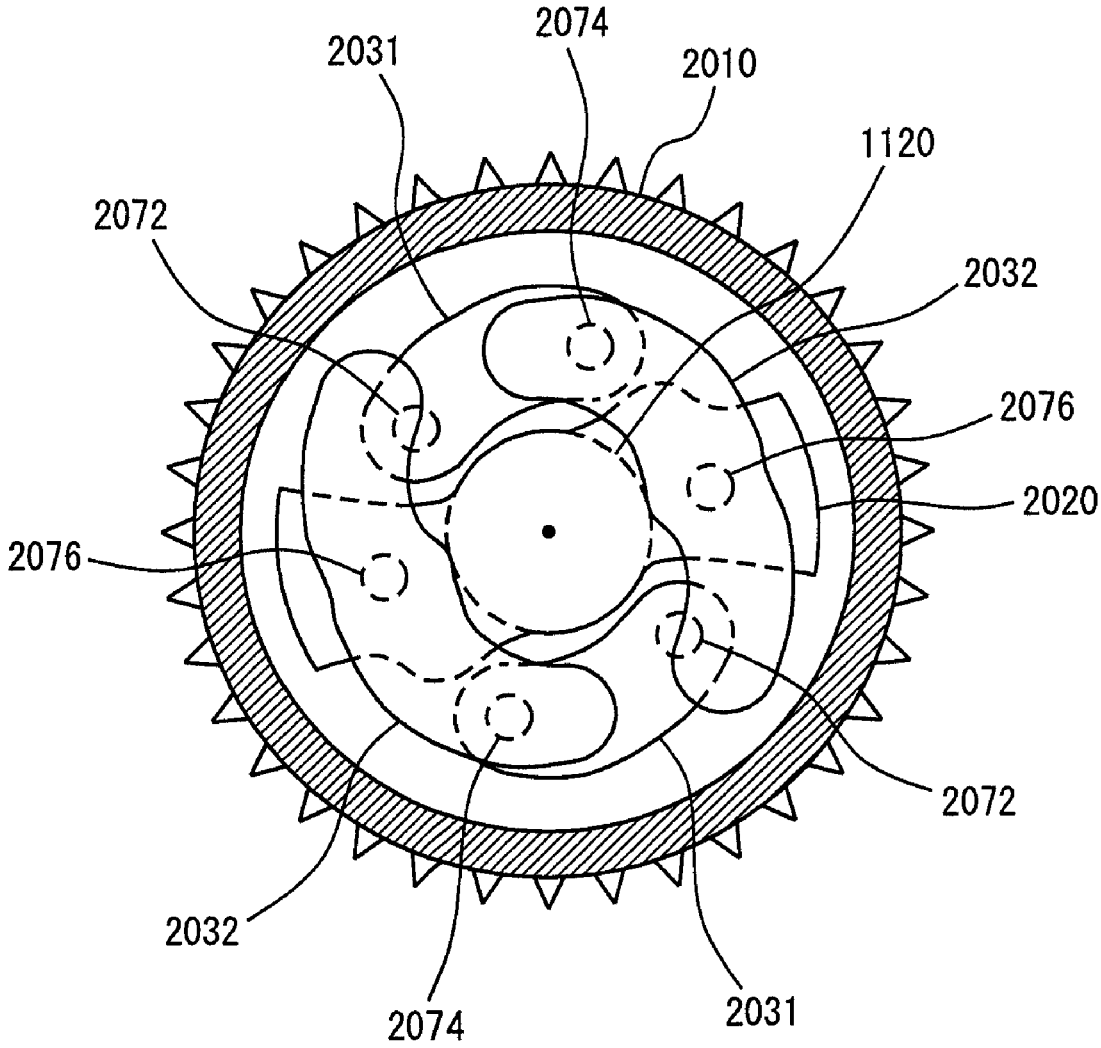
FIG. 6 is a (second) cross section along B-B in FIG. 3.

As shown in FIG. 5 which is a cross section along B-B in FIG. 3 and as shown in FIG. 6 showing the state where the phase of intake valve 1100 is advanced with respect to the state in FIG. 5, arms (1) 2031 and cam plate 2020 are coupled by arms (2) 2032.

Arm (2) 2032 is supported so that the arm can swing about a pin (3) 2074 and with respect to arm (1) 2031. Further, arm (2) 2032 is supported so that the arm can swing about a pin (4) 2076 and with respect to cam plate 2020.

A pair of link mechanisms 2030 causes intake camshaft 1120 to rotate relative to sprocket 2010 and thereby changes the phase of intake valve 1100. Thus, even if one of the paired link mechanisms 2030 is broken as a result of any damage or the like, the other link mechanism can be used to change the phase of intake valve 1100.

Referring back to FIG. 3, at a surface of each link mechanism 2030 (arm (2) 2032) that is a surface thereof facing guide plate 2040, a control pin 2034 is provided. Control pin 2034 is provided concentrically with pin (3) 2074. Each control pin 2034 slides in a guide groove 2042 provided in guide plate 2040.

Each control pin 2034 slides in guide groove 2042 of guide plate 2040, to be shifted in the radial direction. The radial shift of each control pin 2034 causes intake camshaft 1120 to rotate relative to sprocket 2010.

Figure 7:
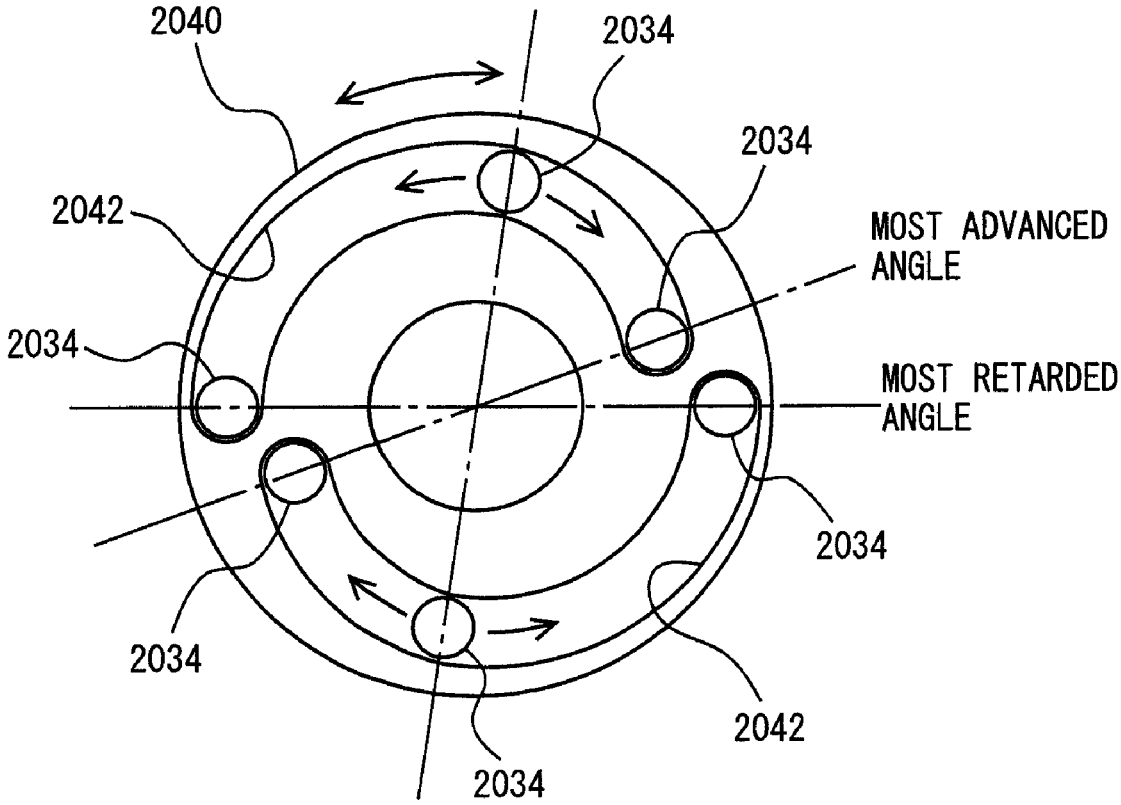
FIG. 7 is a cross section along C-C in FIG. 3.

As shown in FIG. 7 which is a cross section along C-C in FIG. 3, guide groove 2042 is formed in the spiral shape so that rotation of guide plate 2040 causes each control pin 2034 to shift in the radial direction. Here, the shape of guide groove 2042 is not limited to this.

As control pin 2034 is shifted further in the radial direction from the axial center of guide plate 2040, the phase of intake valve 1100 is retarded to a greater extent. In other words, the amount of change of the phase has a value corresponding to the operation amount of link mechanism 2030 generated by the radial shift of control pin 2034. Alternatively, the phase of intake valve 1100 may be advanced to a greater extent as control pin 2034 is shifted further in the radial direction from the axial center of guide plate 2040.

As shown in FIG. 7, when control pin 2034 abuts on an end of guide groove 2042, the operation of link mechanism 2030 is restrained. Therefore, the phase in which control pin 2034 abuts on an end of guide groove 2042 is the phase of the most retarded angle or the most advanced angle.

Referring back to FIG. 3, in guide plate 2040, a plurality of depressed portions 2044 are provided in its surface facing reduction gear 2050, for coupling guide plate 2040 and reduction gear 2050 to each other.

Reduction gear 2050 is comprised of an outer teeth gear 2052 and an inner teeth gear 2054. Outer teeth gear 2052 is fixed with respect to sprocket 2010 so that the gear rotates together with sprocket 2010.

Inner teeth gear 2054 has a plurality of protruded portions 2056 thereon that are received in depressed portions 2044 of guide plate 2040. Inner teeth gear 2054 is supported rotatably about an eccentric axis 2066 of a coupling 2062 formed eccentrically with respect to an axial center 2064 of an output shaft of electric motor 2060.

Figure 8:
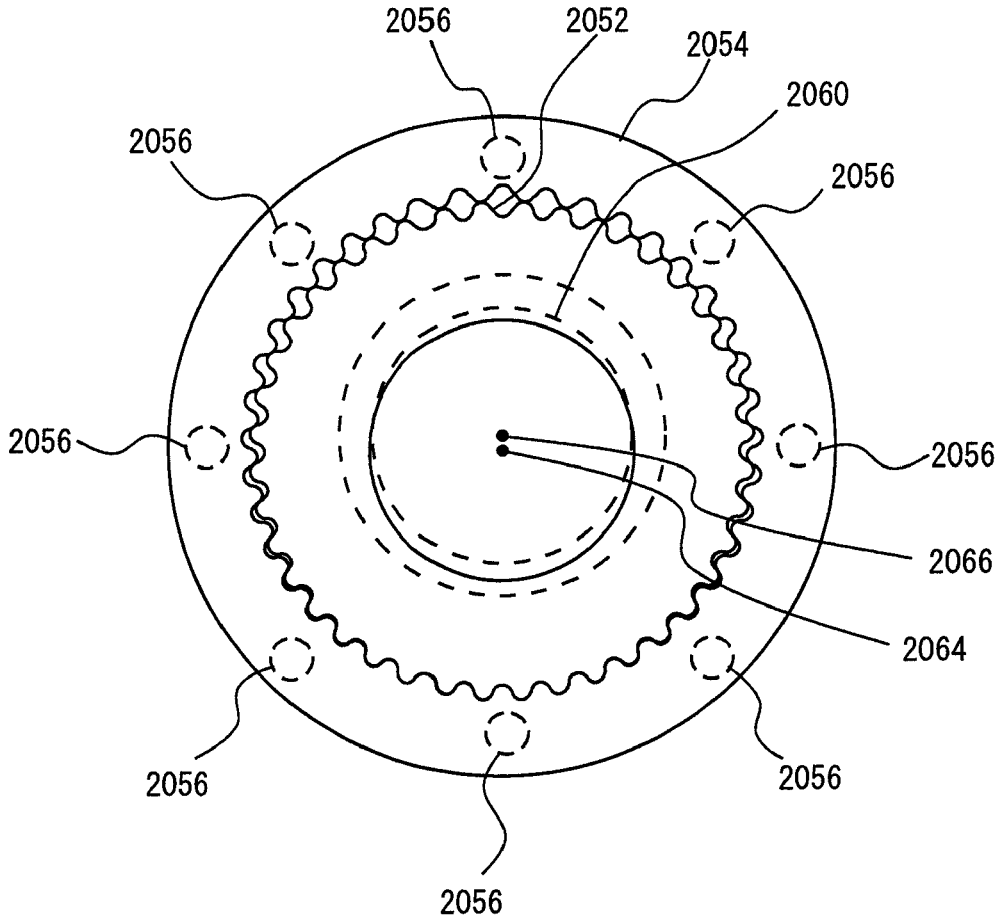
FIG. 8 is a cross section along D-D in FIG. 3.

FIG. 8 shows a cross section along D-D in FIG. 3. Inner teeth gear 2054 is provided such that a part of the teeth thereof meshes with outer teeth gear 2052. In the case where the rotational speed of the output shaft of electric motor 2060 is identical to the rotational speed of sprocket 2010, coupling 2062 and inner teeth gear 2054 rotate at the same rotational speed as that of outer teeth gear 2052 (sprocket 2010). When, guide plate 2040 rotates at the same rotational speed as that of sprocket 2010 and accordingly the phase of intake valve 1100 is maintained.

When electric motor 2060 causes coupling 2062 to rotate about axial center 2064 and relative to outer teeth gear 2052, inner teeth gear 2054 as a whole accordingly revolves about axial center 2064 while inner teeth gear 2054 rotates about eccentric axis 2066. The rotational motion of inner teeth gear 2054 causes guide plate 2040 to rotate relative to sprocket 2010 and thus the phase of intake valve 1100 is changed.

The phase of intake valve 1100 is changed as a result of reduction of the rotational speed of relative rotation between the output shaft of electric motor 2060 and sprocket 2010 (operation amount of electric motor 2060) in reduction gear 2050, guide plate 2040 and link mechanism 2030. Here, the phase of intake valve 1100 may be changed by increasing the rotational speed of relative rotation between the output shaft of electric motor 2060 and sprocket 2010. The output shaft of electric motor 2060 is provided with a motor rotational angle sensor 5050 outputting a signal indicating a rotational angle of the output shaft (the position of the output shaft in the rotational direction). Motor rotational angle sensor 5050 is generally configured to generate a pulse signal every time the output shaft of electric motor 2060 rotates by a prescribed angle. Based on the output from motor rotational angle sensor 5050, the rotational speed of the output shaft of electric motor 2060 (hereinafter, also simply referred to as the rotational speed of electric motor 2060) can be detected.

Figure 9:
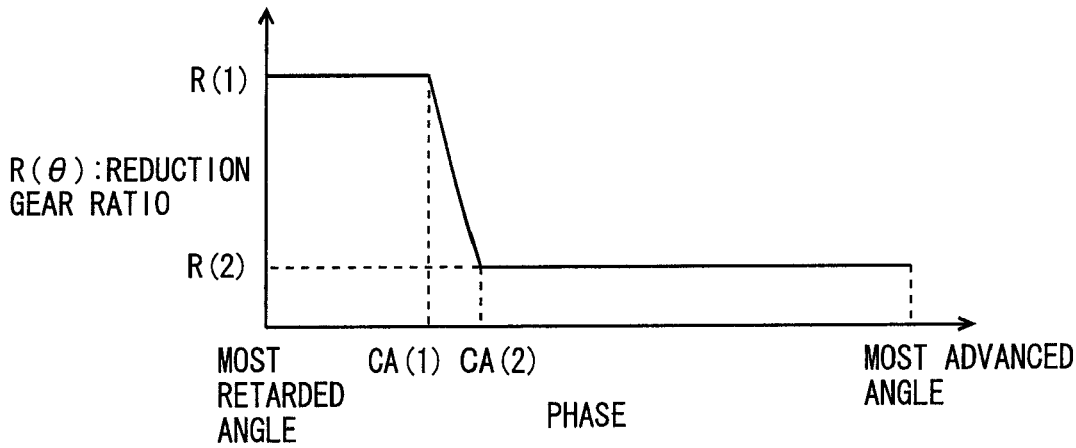
FIG. 9 shows the reduction gear ratio of the intake VVT mechanism as a whole.

As shown in FIG. 9, the reduction gear ratio R (θ) of intake VVT mechanism 2000 as a whole (the ratio of the rotational speed of relative rotation between the output shaft of electric motor 2060 and sprocket 2010 to the amount of the phase-change) may have a value according to the phase of intake valve 1100. In the present embodiment, as the reduction gear ratio is higher, the amount of the phase-change with respect to the rotational speed of relative rotation between the output shaft of electric motor 2060 and sprocket 2010 is smaller.

In the case where the phase of intake valve 1100 is in a first region from the most retarded angle to CA (1), the reduction gear ratio of intake VVT mechanism 2000 as a whole is R (1). In the case where the phase of intake valve 1100 is in a second region from CA (2) (CA (2) is advanced with respect to CA (1)) to the most advanced angle, the reduction gear ratio of intake VVT mechanism 2000 as a whole is R (2) (R (1)>R (2)).

In the case where the phase of intake valve 1100 is in a third region from CA (1) to CA (2), the reduction gear ratio of intake VVT mechanism 2000 as a whole changes at a predetermined rate of change ((R (2)−R (1))/(CA (2)−CA (1)).

The function of intake VVT mechanism 2000 of the variable valve timing apparatus will be described below, which is carried out based on the following structure.

Figure 10:
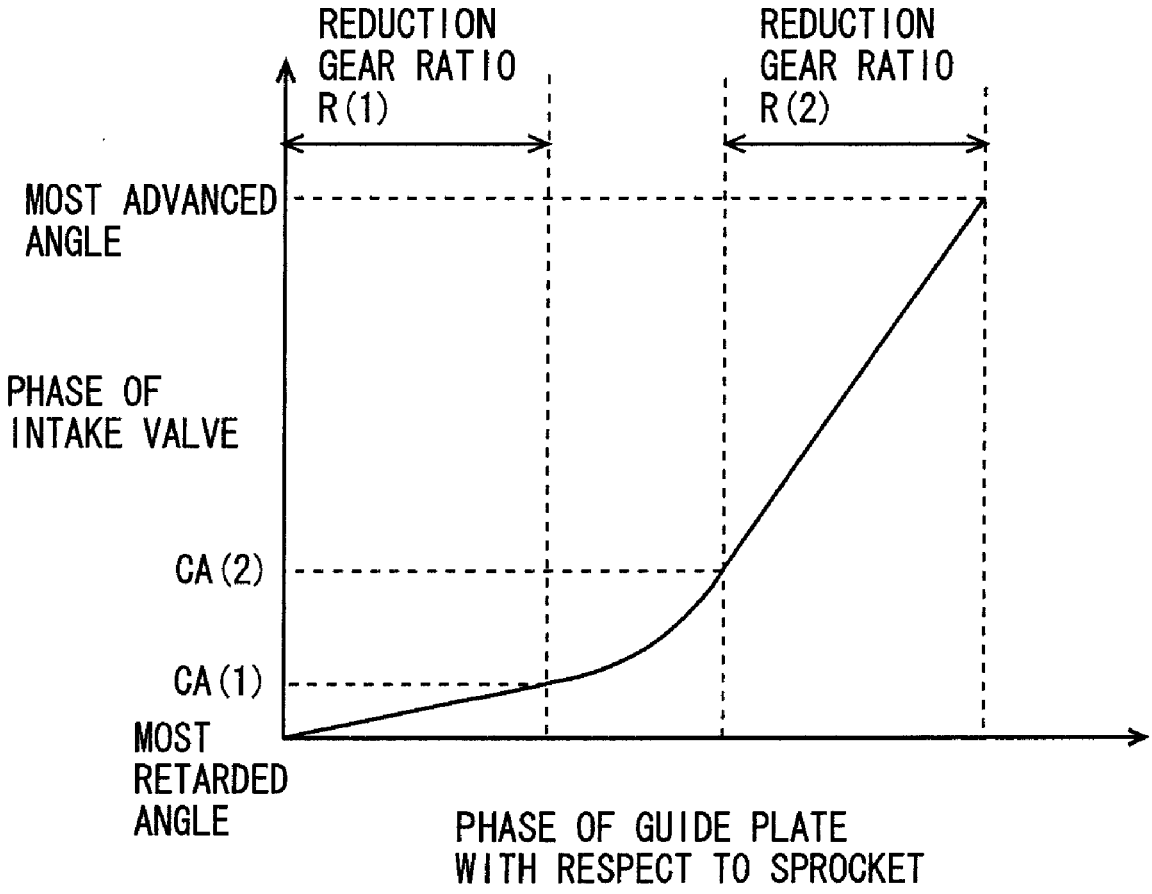
FIG. 10 shows a relation between the phase of a guide plate relative to a sprocket and the phase of the intake camshaft.

When the phase of intake valve 1100 (intake camshaft 1120) is to be advanced, electric motor 2060 is operated to rotate guide plate 2040 relative to sprocket 2010, thereby advancing the phase of intake valve 1100 as shown in FIG. 10.

When the phase of intake valve 1100 is in the first region between the most retarded angle and CA (1), the rotational speed of relative rotation between the output shaft of electric motor 2060 and sprocket 2010 is reduced at reduction gear ratio R (1) to advance the phase of intake valve 1100.

In the case where the phase of intake valve 1100 is in the second region between CA (2) and the most advanced angle, the rotational speed of relative rotation between the output shaft of electric motor 2060 and sprocket 2010 is reduced at reduction gear ratio R (2) to advance the phase of intake valve 1100.

When the phase of intake valve 1100 is to be retarded, the output shaft of electric motor 2060 is rotated relative to sprocket 2010 in the direction opposite to the direction in the case where the phase thereof is to be advanced. As in the case of advancing the phase, when the phase is to be retarded and the phase of intake valve 1100 is in the first region between the most retarded angle and CA (1), the rotational speed of relative rotation between the output shaft of electric motor 2060 and sprocket 2010 is reduced at reduction gear ratio R (1) and the phase is retarded. Further, when the phase of intake valve 1100 is in the second region between CA (2) and the most advanced angle, the rotational speed of relative rotation between the output shaft of electric motor 2060 and sprocket 2010 is reduced at reduction gear ratio R (2) and the phase is retarded.

Accordingly, as long as the direction of the relative rotation between the output shaft of electric motor 2060 and sprocket 2010 is the same, the phase of intake valve 1100 can be advanced or retarded for both of the first region between the most retarded angle and CA (1) and the second region between CA (2) and the most advanced angle. Here, for the second region between CA (2) and the most advanced angle, the phase can be more advanced or more retarded. Thus, the phase can be changed over a wide range.

Further, since the reduction gear ratio is high for the first region between the most retarded angle and CA (1), a large torque is necessary for rotating the output shaft of electric motor 2060 by a torque acting on intake camshaft 1120 as engine 1000 operates. Therefore, even if electric motor 2060 generates no torque as in the case where electric motor 2060 is stopped, rotation can be restrained of the output shaft of electric motor 2060 caused by the torque acting on intake camshaft 1120. Therefore, a change of the actual phase from a phase determined under control can be restrained. Moreover, a phase-change that is not intended can be restrained when power supply to electric motor 2060 as the actuator is stopped.

In the chase where the phase of intake valve 1100 is in the third region between CA (1) and CA (2), the rotational speed of relative rotation between the output shaft of electric motor 2060 and sprocket 2010 is reduced at a reduction gear ratio that changes at a predetermined rate of change, which may result in advance or retard in phase of intake valve 1100.

Accordingly, in the case where the phase changes from the first region to the second region or from the second region to the first region, the amount of the phase-change with respect to the rotational speed of relative rotation between the output shaft of electric motor 2060 and sprocket 2010 can be increased or decreased gradually. In this way, a sudden stepwise change of the amount of the phase-change can be restrained to thereby restrain a sudden change in phase. Accordingly, the capability to control the phase can be improved.

As discussed above, the intake VVT mechanism for the variable valve timing apparatus in the present embodiment provides, in the case where the phase of the intake valve is in the region from the most retarded angle to CA (1), reduction gear ratio of intake VVT mechanism 2000 as a whole is R (1). When the phase of the intake valve is in the region from CA (2) to the most advanced angle, the reduction gear ratio of intake VVT mechanism 2000 as a whole is R (2), which is lower than R (1). Thus, as long as the rotational direction of the output shaft of the electric motor is the same, the phase of the intake valve can be advanced or retarded for both of the regions, namely the first region between the most retarded angle and CA (1) and the second region between CA (2) and the most advanced angle. Here, for the second region between CA (2) and the most advanced angle, the phase can be advanced or retarded to a greater extent. Therefore, the phase can be changed over a wide range. Further, for the first region between the most retarded angle and CA (1), the reduction gear ratio is high and therefore, it is possible to prevent rotation of the output shaft of the electric motor by the torque acting on the intake camshaft as the engine is operated. Thus, a change of the actual phase from a phase determined under control can be restrained. Accordingly, the phase can be changed over a wide range and the phase can be controlled accurately.

Now, a control structure for the phase of intake valve 1100 (hereinafter, also simply referred to as an intake valve phase) will be described in detail.

Figure 11:
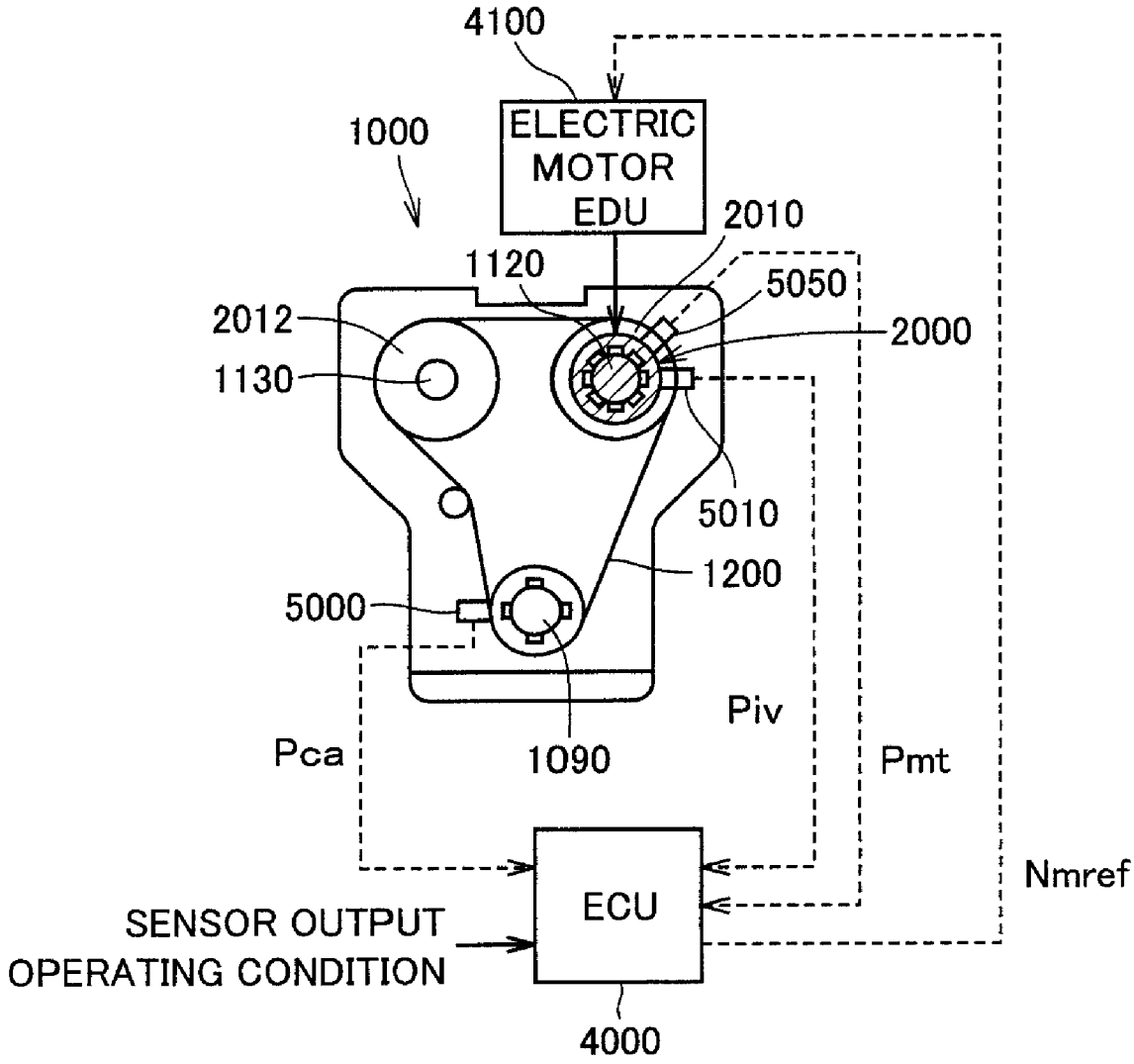
FIG. 11 is a schematic block diagram illustrating a control structure for an intake valve phase using the variable valve timing apparatus in accordance with the present embodiment.

Referring to FIG. 11, as illustrated in FIG. 1, engine 1000 is configured such that power from crankshaft 1090 is transmitted by a timing chain 1200 (or timing belt) to intake camshaft 1120 and exhaust camshaft 1130 through respective sprockets 2010, 2012. Further, cam position sensor 5010 outputting a cam angle signal Piv for each prescribed cam angle is attached on the outer circumference of intake camshaft 1120. On the other hand, crank angle sensor 5000 outputting a crank angle signal Pca for each prescribed crank angle is attached on the outer circumference of crankshaft 1090. In addition, motor rotational angle sensor 5050 outputting a motor rotational angle signal Pmt for each prescribed rotational angle is attached to a rotor (not shown) of electric motor 2060. Cam angle signal Piv, crank angle signal Pca and motor rotational angle signal Pmt are input to ECU 4000.

Further, ECU 4000 controls the operation of engine 1000 so that an output requested for engine 1000 is obtained, based on the outputs from the sensors for detecting a state of engine 1000 and the operating condition (driver pedal operation, current vehicle speed, and the like). As part of the engine control, ECU 4000 sets a target value (target phase) of the respective phases of intake valve 1100 and exhaust valve 1110.

In addition, ECU 4000 generates a rotational speed command value Nmref of electric motor 2060 as an actuator for intake VVT mechanism 2000 so that the phase of intake valve 1100 matches the target phase. Rotational speed command value Nmref is determined corresponding to the rotational speed of the output shaft of electric motor 2060 relative to sprocket 2010 (intake camshaft 1120). The difference in rotation speed of electric motor 2060 relative to intake camshaft 1120 corresponds to the actuator operation amount. An electric motor EDU (Electronic Drive Unit) 4100 controls the rotational speed of electric motor 2060 according to rotational speed command value Nmref from ECU 4000.

Here, at the time of engine stop, the target value of the valve phase (target phase) is set to a valve phase suitable for engine start, in preparation for the next engine start. Therefore, in the case where the intake valve phase at the time of engine stop differs from the target phase suitable for engine start, the variable valve timing apparatus need to change the intake valve phase (that is, the phase of intake camshaft 1120) after the time of engine stop.

Figure 12:
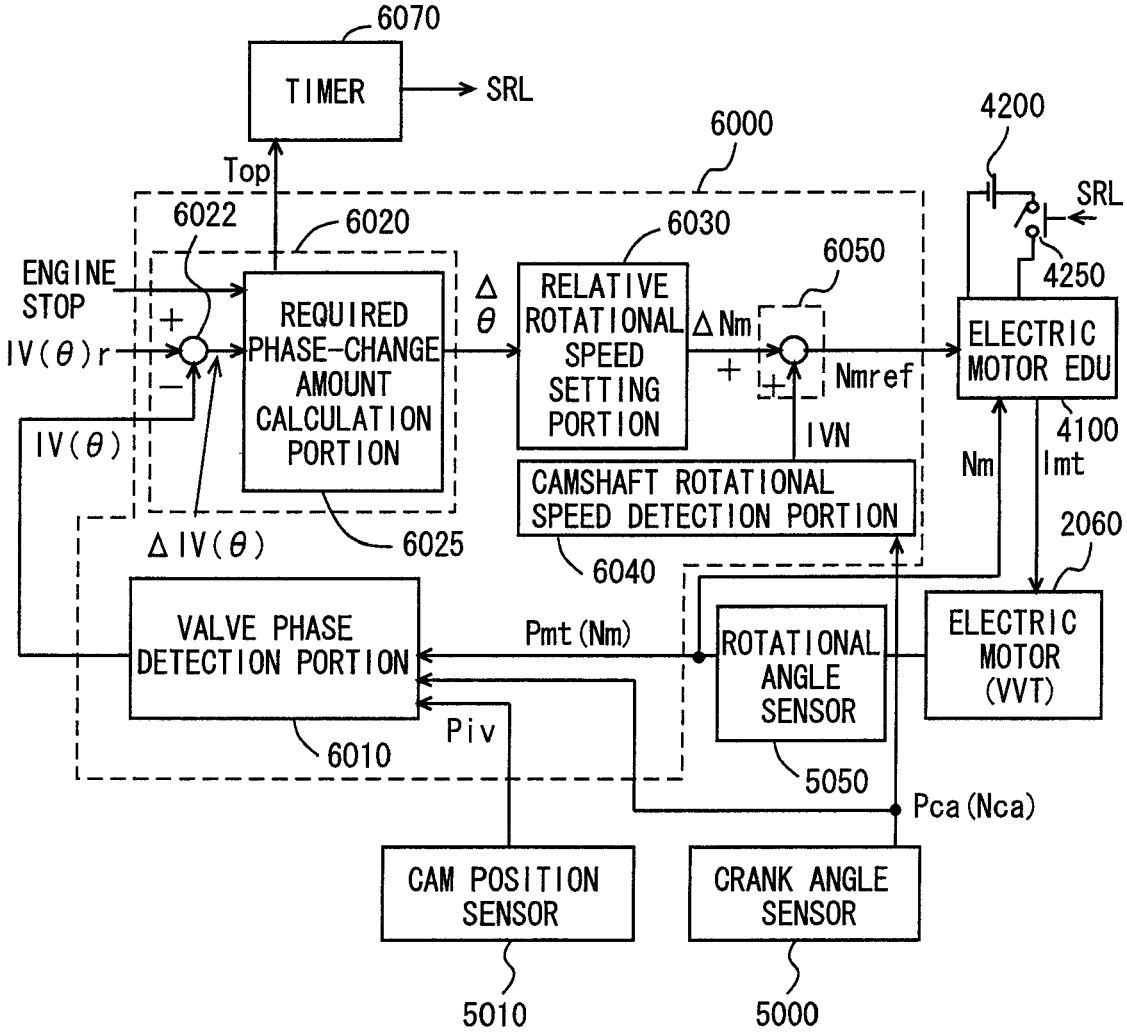
FIG. 12 is a block diagram illustrating rotational speed control for an electric motor as an actuator of the variable valve timing apparatus in accordance with the present embodiment.

FIG. 12 is a block diagram illustrating rotational speed control for electric motor 2060 as the actuator for intake VVT mechanism 2000 in accordance with the embodiment of the present invention.

Referring to FIG. 12, an actuator operation amount setting portion 6000 includes a valve phase detection portion 6010, a camshaft phase-change amount calculation portion 6020, a relative rotational speed setting portion 6030, a camshaft rotational speed detection portion 6040, and a rotational speed command value generation portion 6050. The operation of actuator operation amount setting portion 6000 is realized by executing a control process according to a prescribed program stored in ECU 4000 in advance, for each prescribed control period.

Valve phase detection portion 6010 calculates an actual phase IV(θ) of intake valve 1100 at present (hereinafter, also referred to as "actual intake valve phase IV(θ)") based on crank angle signal Pca from crank angle sensor 5000, cam angle signal Piv from cam position sensor 5010 and motor rotational angle signal Pmt from rotational angle sensor 5050 of electric motor 2060.

Valve phase detection portion 6010 calculates the present phase of intake camshaft 1120, namely the actual intake valve phase, for example, by converting, at the time of generation of cam angle signal Piv, the time difference of cam angle signal Piv from the generation of crank angle signal Pca into the rotational phase difference between crankshaft 1090 and intake camshaft 1120, based on crank angle signal Pca and cam angle signal Piv (a first phase calculation method).

Alternatively, in intake VVT mechanism 2000 in accordance with the embodiment of the present invention, based on the operation amount of electric motor 2060 as an actuator (relative rotational speed ΔNm), the phase-change amount of the intake valve can be traced accurately. Specifically, the actual relative rotational speed ΔNm is calculated based on the output from each sensor, and then the amount of change dIV(θ) of the actual intake valve phase per unit time (every control period) is calculated through an operation process according to the expression (1) as described later based on the calculated actual relative rotational speed ΔNm. Therefore, valve phase detection portion 6010 can also calculate the present phases of intake camshaft 1120, namely the actual intake valve phases one by one also by integrating the amount of change dIV(θ) of the actual phase (a second phase calculation method).

Valve phase detection portion 6010 can detect the actual intake valve phase IV (θ) by using the first and second phase calculation methods as indicated above as appropriate, in consideration of the stability in engine speed, the operation load, and the like. For example, the second phase calculation method as indicated above is used to secure the phase detection accuracy in an unstable engine speed region, specifically in a region of a relatively low rotational speed (for example, in a region of a rotational speed lower than 1000 rpm), while the first phase calculation method as indicated above is used to detect the phase in a high engine speed region where the engine speed is stable and the interval between the cam angle signals is short, thereby preventing increase in operation load of ECU 4000.

Camshaft phase-change amount calculation portion 6020 has a calculating portion 6022 and a required phase-change amount calculation portion 6025. Calculating portion 6022 finds a deviation ΔIV(θ) of actual intake valve phase IV(θ) from target phase IV(θ)r (ΔIV(θ)=IV(θ)−IV(θ)r). Required phase-change amount calculation portion 6025 calculates a required phase-change amount Δθ for intake camshaft 1120 in this control period, according to the deviation ΔIV(θ) found by calculating portion 6022.

For example, a maximum value Δθmax of phase-change amount Δθ in a single control period is preset, so that required phase-change amount calculation portion 6025 determines phase-change amount Δθ according to the deviation ΔIV(θ) in the range of the maximum value Δθmax. Here, the maximum value Δθmax may be a prescribed fixed value. Alternatively, required phase-change amount calculation portion 6025 may set the maximum value Δθmax variably according to the operating state of engine 1000 (rotational speed, intake air quantity, and the like) or the magnitude of phase deviation ΔIV(θ). Further, phase-change amount Δθ may be set according to deviation ΔIV(θ) of the actual intake valve phase and a prescribed conversion ratio Kθ in the range of the maximum value Δθmax (specifically, Δθ=Kθ·ΔIV(θ)).

Relative rotational speed setting portion 6030 calculates the rotational speed ΔNm of the output shaft of electric motor 2060 relative to the rotational speed of sprocket 2010 (intake camshaft 1120), which is required to produce required phase-change amount Δθ obtained by required phase-change amount calculation portion 6025. For example, the relative rotational speed ΔNm is set at a positive value (ΔNm>0) when the intake valve phase is to be advanced. By contrast, the relative rotational speed ΔNm is set at a negative value (ΔNm<0) when the intake valve phase is to be retarded, and the relative rotational speed ΔNm is set at approximately 0 (ΔNm=0) when the present intake valve phase is to be maintained.

Here, the relation between the phase-change amount Δθ and the relative rotational speed ΔNm per unit time ΔT corresponding to the control period is represented by the following expression (1). It is noted that in the expression (1), R(θ) is a reduction gear ratio which varies according to the intake valve phase as shown in FIG. 9.

$$\Delta\theta \propto \Delta Nm \cdot 360° \cdot (1/R(\theta)) \cdot \Delta T \quad (1)$$

Accordingly, relative rotational speed setting portion 6030 can find relative rotational speed ΔNm of electric motor 2060 for producing camshaft phase-change amount Δθ required in control period ΔT, through an operation process according to the expression (1).

Camshaft rotational speed detection portion 6040 obtains the rotational speed of sprocket 2010, namely the actual rotational speed IVN of intake camshaft 1120, as being half the rotational speed of crankshaft 1090. Here, camshaft rotational speed detection portion 6040 may be configured to calculate the actual rotational speed IVN of intake camshaft 1120 based on cam angle signal Piv from cam position sensor 5010. Here, the number of outputs of the cam angle signal per revolution of intake camshaft 1120 is generally smaller than the number of outputs of the crank angle signal per revolution of crankshaft 1090, and therefore the detection accuracy can be improved by detecting the camshaft rotational speed IVN based on the rotational speed of crankshaft 1090.

Rotational speed command value generation portion 6050 performs an addition of the actual rotational speed IVN of intake camshaft 1120 obtained by camshaft rotational speed detection portion 6040 and the relative rotational speed ΔNm set by relative rotational speed setting portion 6030 to generate rotational speed command value Nmref for electric motor 2060. The rotational speed command value Nmref generated by rotational speed command value generation portion 6050 is sent to electric motor EDU 4100.

Electric motor EDU 4100 is connected to a power source 4200 through a relay circuit 4250. The on/off of relay circuit 4250 is controlled by a control signal SRL. Power source 4200 is generally formed of a secondary battery rechargeable at the time of engine operation. Therefore, the valve phase (namely, the camshaft phase) can be changed by continuously turning on relay circuit 4250 using a timer 6070 even after engine stop to operate electric motor 2060 as the actuator for a prescribed period of time.

Electric motor EDU 4100 controls the rotational speed such that the rotational speed of electric motor 2060 matches rotational speed command value Nmref. For example, electric motor EDU 4100 controls switching of a power semiconductor device (for example, transistor) so that supply power (typically, motor current Imt) from power source 4200 to electric motor 2060 is controlled according to a rotational speed deviation (Nref−Nm) of actual rotational speed Nm of electric motor 2060 from rotational speed command value Nmref. For example, a duty ratio in the switching operation of such a power semiconductor device is controlled.

In particular, electric motor EDU 4100 controls duty ratio DTY which is the amount of adjustment in rotational speed control, in order to improve motor controllability.

$$DTY=DTY(ST)+DTY(FB) \quad (2)$$

In the expression (2), DTY (FB) is a feedback term based on a control operation (typically, general P control, PI control, or the like) using the above-noted rotational speed deviation and prescribed control gain.

Figure 13:
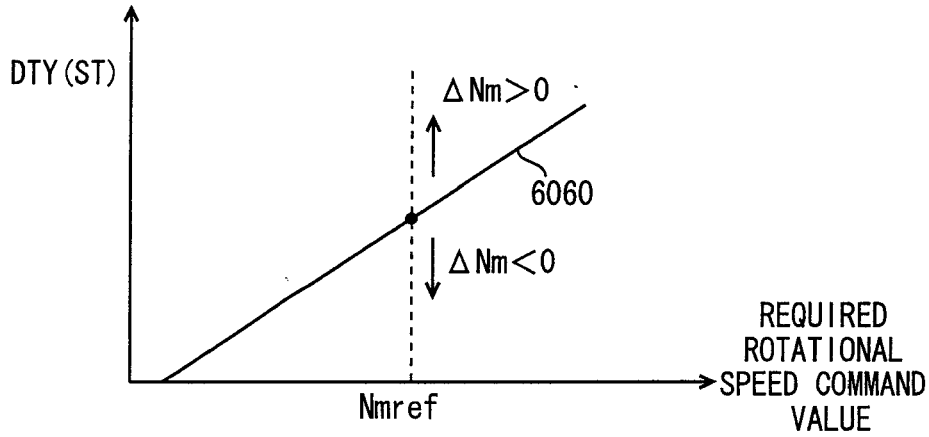
FIG. 13 schematically shows speed control for the electric motor.

DTY (ST) in the expression (2) is a preset term set based on the rotational speed command value Nmref and the set relative rotational speed ΔNm of electric motor 2060 as shown in FIG. 13.

Referring to FIG. 13, a duty ratio characteristic 6060 is represented in a table beforehand, which is associated with the motor current value required when the relative rotational speed ΔNm=0, that is, when electric motor 2060 rotates at the same rotational speed as sprocket 2010 (ΔNm=0) with respect to rotational speed command value Nmref. Then, DTY (ST) in the expression (2) is set by relatively increasing/decreasing the electric current value corresponding to the relative rotational speed ΔNm, from the reference value depending on duty ratio characteristic 6060. Because of the rotational speed control in which supply power to electric motor 2060 is controlled with a combination of the preset term and the feedback term in this manner, electric motor EDU 4100 allows the rotational speed of electric motor 2060 to follow a change in rotational speed command value Nmref at high speed, as compared with a simple feedback control, that is, the rotational speed control only using the DTY (FB) term in the expression (2).

(Setting of Actuator Operation Amount According to Embodiment of the Present Invention)

Figure 14:
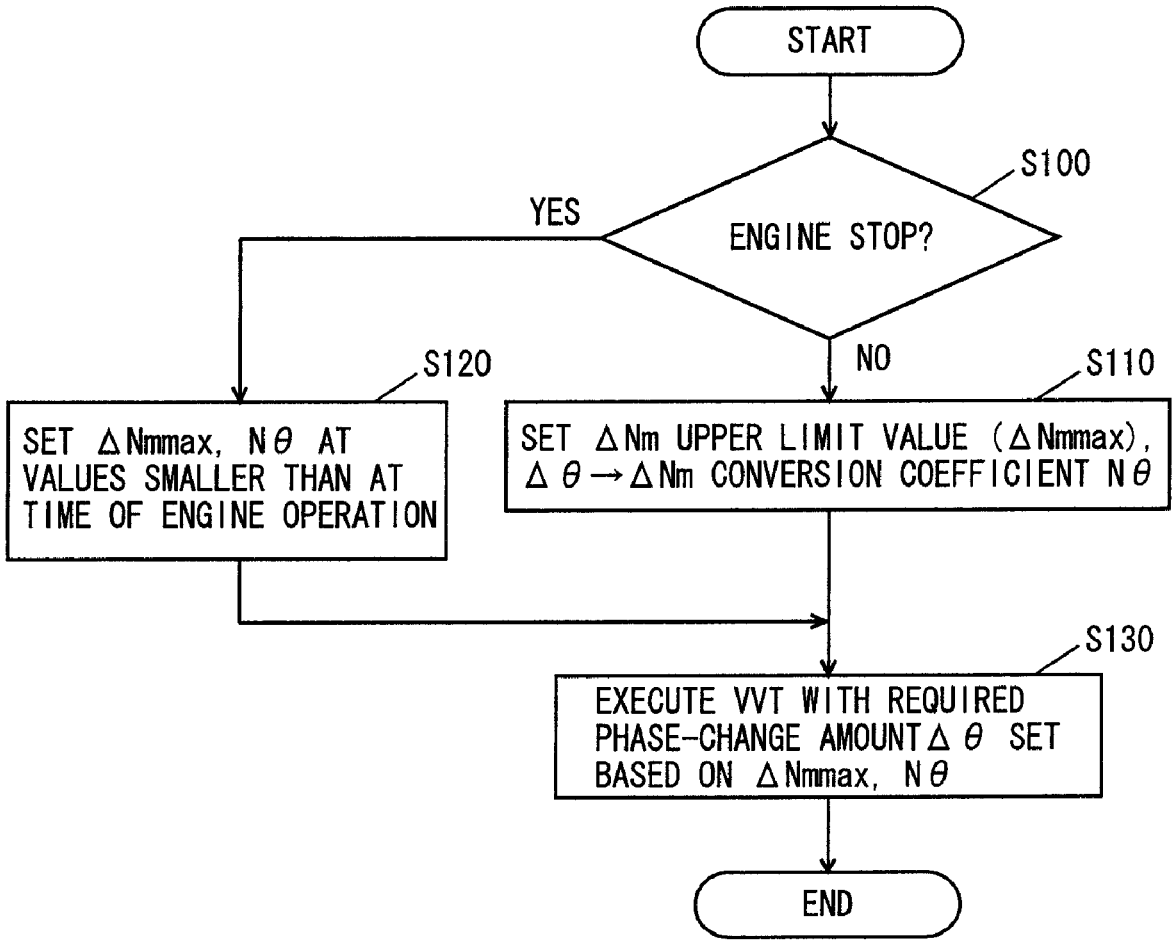
FIG. 14 is a flowchart illustrating an example of setting an actuator operation amount (relative rotation speed of the electric motor) in the variable valve timing apparatus in accordance with the embodiment of the present invention.

In the embodiment of the present invention, the setting of relative rotational speed ΔNm of electric motor 2060 (namely, the actuator operation amount) based on phase-change amount Δθ by relative rotational speed setting portion 6030 in FIG. 12 is performed according to the flowchart shown in FIG. 14. The actuator operation amount setting according to the flowchart in FIG. 14 is performed by ECU 4000, as part of the valve timing control by intake VVT mechanism 2000.

ECU 4000 determines whether or not engine 1000 is stopped, at step S100. Then, at the time of engine operation (if NO at step S11000), the upper limit value ΔNmmax and conversion coefficient Nθ in setting the relative rotational speed ΔNm of electric motor 2060 in relative rotational speed setting portion 6030 (FIG. 12) are set at normal values (step S110). For example, the normal value of conversion coefficient NO is set corresponding to reduction gear ratio R (θ), according to the expression (1) as indicated above.

On the other hand, at the time of engine stop (if YES at step S100), ECU 4000 sets the upper limit value ΔNmmax and conversion coefficient Nθ for relative rotational speed ΔNm at values smaller than the normal values set at step S10 (step S120).

Then, ECU 4000 sets the relative rotational speed ΔNm according to the following expression (3) in a range in which it does not exceed the set upper limit value ΔNmmax, in converting the required phase-change amount Δθ obtained by required phase-change amount calculation portion 6025 into relative rotational speed ΔNm of electric motor 2060. In other words, the process at step S130 corresponds to the operation of relative rotational speed setting portion 6030 (FIG. 12).

$$\Delta Nm=N\theta\cdot\Delta\theta \quad (3)$$

Then, intake VVT mechanism 2000 operates according to the relative rotational speed ΔNm set by relative rotational speed setting portion 6030, so that the phase of intake valve 1100 is gradually changed to the target phase at the time of engine stop. When the intake valve phase reaches this target phase, the control of electric motor 2060 is stopped and relay circuit 4250 is turned off. For example, when the deviation of the intake valve phase from the target phase becomes equal to or smaller than a prescribed determination value, it is determined that the intake valve phase reaches the target phase.

As illustrated above, the relative rotational speed ΔNm of electric motor 2060 which is the actuator operation amount is limited so as to be smaller at the time of engine stop than at the time of engine operation. Therefore, at the time of engine stop when the rotational speed of intake camshaft 1120 and crankshaft 1090 is 0, the rotational speed of electric motor 2060 for VVT can be reduced. Accordingly, the rotational speed of each gear in reduction gear 2050 is also reduced. As a result, at the time of engine stop when the passenger is likely to perceive noise, in consideration of less need for increasing the speed of changing the valve phase (namely, the camshaft phase), the actuator operation amount is reduced to reduce the operation sound of intake VVT mechanism 2000 thereby preventing unusual sound or noise from being perceived by the passenger.

It is noted that the flowchart in FIG. 14 illustrates an example in which the upper limit value ΔNmmax and conversion coefficient Nθ for relative rotational speed ΔNm in each control period are set smaller at the time of engine stop than at the time of engine operation, at steps S110 and S120. Alternatively, the maximum value Δθmax and conversion coefficient Kθ for the phase-change amount Δθ in each control period (required phase-change amount calculation portion 6025) may be set relatively small at the time of engine stop, achieving the similar effect as described above.

(Actuator Power Supply Control at Engine Stop According to Embodiment of the Present Invention)

As described above, after engine stop, electric motor 2060 as the actuator is operated by keeping relay circuit 4250 on. However, in consideration of the importance of valve phase setting at the time of engine stop, the operation of electric motor 2060 for a long time until the valve phase reaches the target phase at the time of engine stop wastes power from power source 4200.

Therefore, in the present embodiment, as described below, the upper limit value in the on duration time of relay circuit 4250 after engine stop, namely during the period of operation of electric motor 2060 after engine stop, is set as follows.

Referring to FIG. 12 again, required phase-change amount calculation portion 6025 can find a deviation ΔIV(θ)# of actual intake valve phase IV(θ), at the time of engine stop, from the target phase at the time of engine stop, in response to a signal (for example, an off signal of the ignition switch) generated in response to engine stop.

Required phase-change amount calculation portion 6025 additionally estimates the operation period of electric motor 2060 which is required for the intake valve phase to reach the target phase at the time of engine stop, according to the above-noted deviation ΔIV(θ)#, in consideration of the set upper limit value ΔNmmax and conversion coefficient Nθ for the relative rotational speed at the time of engine stop, which are set at step S120. Therefore, the on duration period Top of relay circuit 4250 required after engine stop (also referred to as operation period Top, hereinafter) can be set corresponding to the estimated operation period of electric motor 2060. For example, a table for setting operation period Top can be created beforehand corresponding to the intake valve phase deviation ΔIV(θ)# at the time of engine stop.

Figure 15:
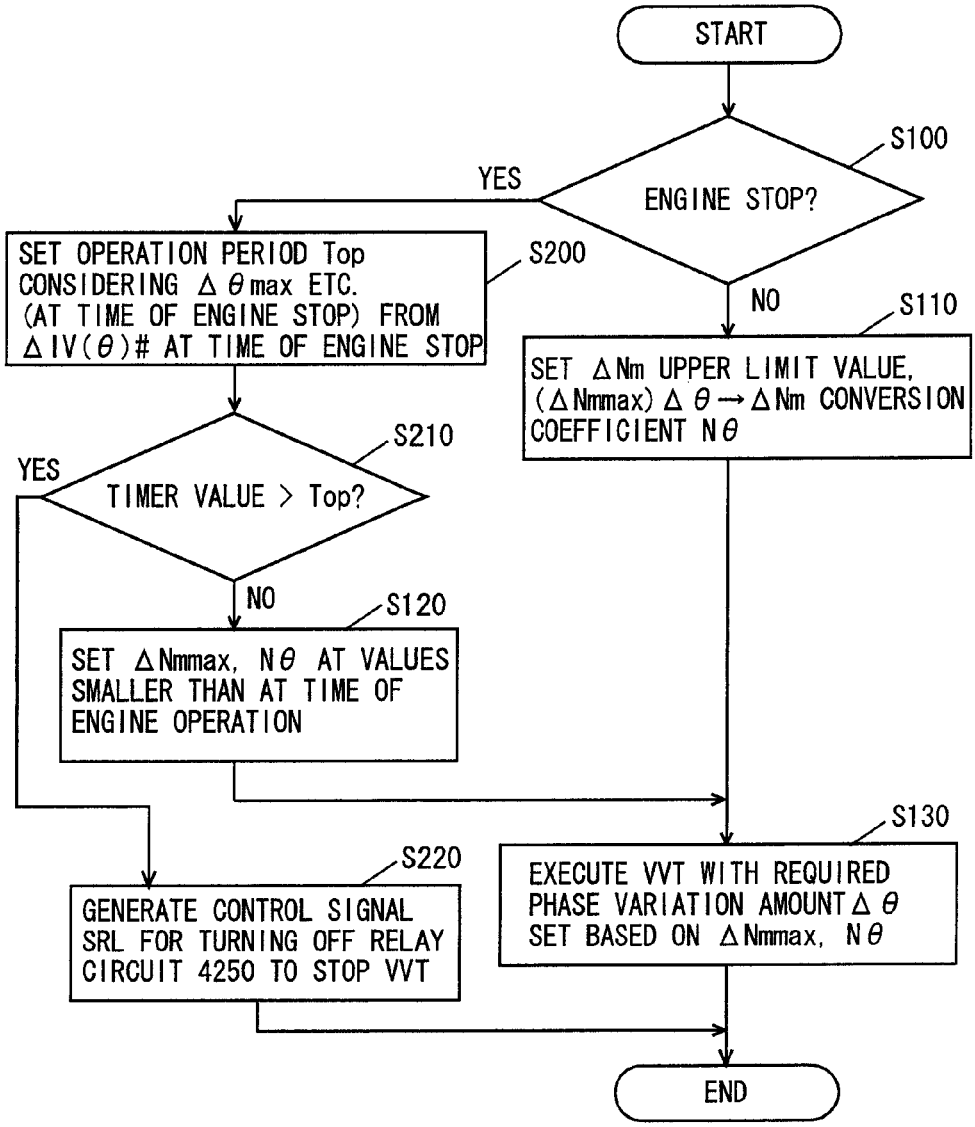
FIG. 15 is a flowchart illustrating actuator (electric motor) power supply control after engine stop in the variable valve timing apparatus in accordance with the embodiment of the present invention.

FIG. 15 shows a flowchart illustrating the actuator (electric motor) power supply control at the time of engine stop in the variable valve timing apparatus in accordance with the embodiment of the present invention.

Referring to FIG. 15, ECU 4000 sets the operation period Top of electric motor 2060 required after engine stop, for example with reference to the above-noted table created in consideration of the set upper limit value ΔNmmax and conversion coefficient Nθ, according to the intake valve phase deviation ΔIV(θ)# at the time of engine stop (if YES at step S1100), at step S200. The control process at the time of engine operation (if No at step S100) is similar to the one in FIG. 14 and the description will not be repeated.

At the time of engine stop (if YES at step S1100), ECU 4000, in addition, compares the operation period Top set at step S110 with the timer value of timer 6070 which starts counting at the time of engine stop, at step S210.

When the timer value is equal to or smaller than the operation period Top (if NO at step S210), ECU 4000 gradually changes the intake valve phase to the target phase at the time of engine stop in a state in which the operation sound of intake VVT mechanism 2000 is reduced by limiting the actuator operation amount, at steps S120, S130, similarly to FIG. 14. Then, when the intake valve phase reaches this target phase, the control of electric motor 2060 is stopped and relay circuit 4250 is turned off On the other hand, when the timer value exceeds the operation period Top (if YES at step S210), at step S220, ECU 4000 generates control signal SRL to turn off relay circuit 4250 even in a state in which the present intake valve phase does not reach the target phase. Accordingly, the power supply to electric motor 2060 as the actuator is stopped thereby forcing the operation of intake VVT mechanism 2000 to stop. Alternatively, the power supply to electric motor 2060 (actuator) can be stopped by control of electric motor EDU 4100.

Thus, the period of power supply to electric motor 2060 (operation period) after engine stop is set properly and appropriately thereby saving power consumption and preventing overheating caused by overload due to the operation of electric motor 2060 for a long time until the valve phase reaches the target phase after engine stop.

Here, in the flowchart in FIG. 15, step S120 may be omitted and steps S110 and S130 may be executed, if NO at step S210. More specifically, even if limiting the actuator operation amount for reducing the operation sound at the time of engine stop as shown in FIG. 14 may not be executed, the period of power supply to electric motor 2060 (operation period) after engine stop can be set properly and appropriately thereby saving power consumption and preventing overheating caused by overload. In this case, a table or the like for obtaining operation period Top may be created from intake valve phase deviation ΔIV(θ)# at the time of engine stop, based on the set upper limit value ΔNmmax and conversion coefficient Nθ which are common to those at the time of engine operation.

In the foregoing embodiment, step S110 in FIGS. 14 and 15 corresponds to "actuator limiting means" or "operation amount limiting step" in the present invention, and step S130 corresponds to "operation amount setting step" in the present invention, step S200 in FIG. 15 corresponds to "setting means (step)" in the present invention, and steps S210, S220 correspond to "forcedly stopping means (step)" in the present invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A variable valve timing apparatus changing an opening/closing timing of at least any one of an intake valve and an exhaust valve provided to an engine, comprising:

an actuator;

a change mechanism changing said opening/closing timing by changing difference in rotational phase of a camshaft driving the valve having said opening/closing timing changed, from a rotational phase of a crankshaft, at an amount of change according to an operation amount of said actuator; and an actuator operation amount setting portion setting the operation amount of said actuator, based on a deviation between said opening/closing timing at present of the valve having said opening/closing timing changed and a target value thereof, said actuator operation amount setting portion including actuator limiting means for setting the operation amount of said actuator to be smaller than at a time of engine operation, in a case where said opening/closing timing is changed at a time of engine stop.

2. The variable valve timing apparatus according to claim 1, wherein said actuator limiting means sets an upper limit value of the operation amount of said actuator in each control period to be smaller at a time of said engine stop than at a time of said engine operation.

3. The variable valve timing apparatus according to claim 1, wherein said actuator limiting means sets a calculation ratio of the operation amount of said actuator to the deviation of said opening/closing timing in each control period to be smaller at a time of said engine stop than at a time of said engine operation.

4. The variable valve timing apparatus according to claim 1, wherein, at a time of said engine stop, the target value of said opening/closing timing is set at a prescribed value suitable for a next engine start.

5. The variable valve timing apparatus according to claim 1, further comprising:

setting means for setting an operation period after stopping, according to a deviation of an actual value of said opening/closing timing at a time of said engine stop from the target value of said opening/closing timing at a time of said engine stop; and forcedly stopping means for forcedly stopping an operation of said actuator when said operation period after stopping set by said setting means has elapsed since the time of said engine stop.

6. The variable valve timing apparatus according to claim 1, wherein said actuator is formed of an electric motor and the operation amount of said actuator is a rotational speed difference of said electric motor relative to a rotational speed of said camshaft.

7. A variable valve timing apparatus changing an opening/closing timing of at least any one of an intake valve and an exhaust valve provided to an engine, comprising:

an actuator;

a change mechanism changing said opening/closing timing by changing difference in rotational phase of a camshaft driving the valve having said opening/closing timing changed, from a rotational phase of a crankshaft, at an amount of change according to an operation amount of said actuator; and a control unit setting the operation amount of said actuator, based on a deviation between said opening/closing timing at present of the valve having said opening/closing timing changed and a target value thereof, wherein said control unit sets the operation amount of said actuator to be smaller than at a time of engine operation, in a case where said opening/closing timing is changed at a time of engine stop.

8. The variable valve timing apparatus according to claim 7, wherein said control unit sets an upper limit value of the operation amount of said actuator in each control period to be smaller at a time of said engine stop than at a time of said engine operation.

9. The variable valve timing apparatus according to claim 7, wherein said control unit sets a calculation ratio of the operation amount of said actuator to the deviation of said opening/closing timing in each control period to be smaller at a time of said engine stop than at a time of said engine operation.

10. The variable valve timing apparatus according to claim 7, wherein, at a time of said engine stop, said control unit sets the target value of said opening/closing timing at a prescribed value suitable for a next engine start.

11. The variable valve timing apparatus according to claim 7, wherein said control unit sets an operation period after stopping, according to a deviation of an actual value of said opening/closing timing at a time of said engine stop from the target value of said opening/closing timing at a time of said engine stop, and in addition, forcedly stops an operation of said actuator when said set operation period after stopping has elapsed since the time of said engine stop.

12. The variable valve timing apparatus according to claim 7, wherein said actuator is formed of an electric motor and the operation amount of said actuator is a rotational speed difference of said electric motor relative to a rotational speed of said camshaft.

13. A control method of a variable valve timing apparatus changing an opening/closing timing of at least any one of an intake valve and an exhaust valve provided to an engine, said variable valve timing apparatus including an actuator and a change mechanism changing said opening/closing timing by changing difference in rotational phase of a camshaft driving the valve having said opening/closing timing changed, from a rotational phase of a crankshaft, at an amount of change according to an operation amount of said actuator, said method comprising:

an operation amount setting step of setting an operation amount of said actuator, based on a deviation between said opening/closing timing at present of the valve having said opening/closing timing changed and a target value thereof; and an operation amount limiting step of limiting the operation amount of said actuator set at said operation amount setting step to be smaller than at a time of engine operation, in a case where said opening/closing timing is changed at a time of engine stop.

14. The control method of a variable valve timing apparatus according to claim 13, wherein at said operation amount limiting step, an upper limit value of the operation amount of said actuator at said operation amount setting step in each control period is set smaller at a time of said engine stop than at a time of said engine operation.

15. The control method of a variable valve timing apparatus according to claim 13, wherein at said operation amount limiting step, a calculation ratio of the operation amount of said actuator to the deviation of said opening/closing timing at said operation amount setting step in each control period is set smaller at a time of said engine stop than at a time of said engine operation.

16. The control method of a variable valve timing apparatus according to claim 13, wherein, at a time of said engine stop, the target value of said opening/closing timing is set at a prescribed value suitable for a next engine start.

17. The control method of a variable valve timing apparatus according to claim 13, further comprising:

a setting step of setting an operation period after stopping, according to a deviation of an actual value of said opening/closing timing at a time of said engine stop from the target value of said opening/closing timing at a time of said engine stop; and a forcedly stopping step of forcedly stopping an operation of said actuator when said operation period after stopping set at said setting step has elapsed since the time of said engine stop.

18. The control method of a variable valve timing apparatus according to claim 13, wherein said actuator is formed of an electric motor and the operation amount of said actuator is a rotational speed difference of said electric motor relative to a rotational speed of said camshaft.

* * * * *